United States Patent [19]

Manson

[11] Patent Number: 4,818,979

[45] Date of Patent: Apr. 4, 1989

[54] LUT OUTPUT FOR GRAPHICS DISPLAY

[75] Inventor: Donald C. Manson, Northbridge, Mass.

[73] Assignee: Prime Computer, Inc., Natick, Mass.

[21] Appl. No.: 834,756

[22] Filed: Feb. 28, 1986

[51] Int. Cl.[4] ..... G09G 1/16

[52] U.S. Cl. ..... 340/723; 340/703; 340/747; 340/799; 340/721

[58] Field of Search ..... 340/703, 799, 798, 723, 340/747, 709, 721, 790, 734, 745

[56] References Cited

U.S. PATENT DOCUMENTS

| | | | |
|---|---|---|---|
| Re. 31,200 | 4/1983 | Sukonick et al. | 340/721 |
| 4,429,306 | 1/1984 | Macauley et al. | 340/790 |
| 4,599,610 | 7/1986 | Lacy | 340/709 |
| 4,639,768 | 1/1987 | Ueno et al. | 340/721 |
| 4,673,929 | 6/1987 | Nelson et al. | 340/703 |
| 4,682,297 | 7/1987 | Iwami | 340/721 |

OTHER PUBLICATIONS

J. D. Foley and A. Van Dam, Fundamentals of Interactive Computer Graphics, Jul., 1984, pp. 132–133, FIG. 3.37 and pp. 489–491, FIGS. 12.5–12.8.

*Primary Examiner*—Marshall M. Curtis

*Attorney, Agent, or Firm*—Wolf, Greenfield & Sacks

[57] ABSTRACT

A scanning display signal generating system for a plurality of planes includes a first look up table addressed by a first set of the planes, and a second look up table addressed by a second set of planes. A logic unit receives the outputs of the tables and provides a display signal which is a selected logical combination of the outputs. A function control unit provides a control signal to the logic unit to select the desired logical combination. A large number of planes are thus displayed using small LUT memory components, providing display values in real time to the scanner. The output of one look up table may be provided as a control signal to the logic unit. In one embodiment the first look up table is addressed by text planes, and an output therefrom provides the control signal for suppressing the output of the second look up table.

18 Claims, 2 Drawing Sheets

LUT OUTPUT FOR GRAPHICS DISPLAY

BACKGROUND OF THE INVENTION

In the conventional display of video data, the intensity of a scanning beam in a cathode ray tube is controlled as it scans along raster scan lines so as to create an image on the display tube. Typically, to control the color and intensity values displayed, a display memory is maintained having one memory address corresponding to each picture element or pixel on the display screen. A stream of ditigal data representative of the scan path of the cathode ray tube beam is fed to the display memory. The output of the memory at each address is fed to a ditigal to analog converter (DAC) which in turn provides an analog signal for controlling the CRT beam intensity at the pixel on the display corresponding to that address.

As a practical matter, the number of desired intensity values of the scanning beam is quite small. They may, for instance, include two values for "on" and "off", or may more generally include three primary colors and eight or sixteen intensity levels. This information may be stored as several bytes or less of data at each address of the display memory. When it is desired to simultaneously display information from several planes, however, it becomes impractical to store the display values separately for each plane. Instead, in order to control the scanning beam it is a common practice to maintain data representing these display values in a look up table (LUT). The display memory contains, at each storage location, a short data word The data words from corresponding points of all the planes are combined to form an address in the look up table, and a data word representing the desired display value is stored at that address By way of example, the display memory may consist of a 512×512×8 bit RAM, and the look up table may be a 128×8 bit RAM. Each of the addresses in the display memory may hold a single eight bit word which identifies an address in the look up table. Each of the 128 addresses in the look up table accesses a single eight bit word which represents the color and/or intensity value to be displayed.

Where the system is an engineering or a graphics display system, several planes P1, P2, . . . Pn of graphics must be stored in a manner for simultaneous display on the screen. In such a case, the intensity and color value V displayed at a point $(x,y)_s$ on the screen will be a function of the corresponding points $(x,y)_{P1}$, $(x,y)_{P2}$ . . . $(x,y)_{Pn}$ of the n planes. For example, if the stored planes all represent horizontal sections through a building, and the screen is to display a vertical view from above, the top plane could be displayed in its entirety at a first intensity or color, and the portions of the other planes be displayed only where they are visible through gaps in the top or overlying planes, each displayed at a progressively lesser intensity or different color. Similarly, for a perspective view, the intersection contours of non-parallel planes may be highlighted.

Such display presentations are conventionally implemented using a look up table, as shown in FIG. 1, below In such a construction, each point $(x,y)_i$ in a plane $P_i$ stores part of an address in the look up table, and the output of the look up table is an illumination value V(P1, . . . Pn) which is a function of the n points (one in each plane) corresponding to the point $(x,y)_s$ on the screen. With such a prior art look up table, if n planes are available for simultaneous viewing on the screen, the size of the memory required for the look up table varies as $2^n$. For n greater than approximately eight, a memory of suitable size has slow access times, in the range of 25 ns or more. Such access times impose limitations on the system design and performance.

OBJECTS AND SUMMARY OF THE INVENTION

It is an object of the invention to provide a look up table arrangement for a graphic display system operable with a large number of displayable planes.

It is another object of the invention to provide a look up table arrangement for a graphic display system allowing short access times.

It is another of the invention to provide a look up table arrangement for a graphic display system wherein different displayable planes provide addresses to separate look up tables, permitting the use of smaller look up tables.

It is a further object of the invention to provide such a look up table arrangement, wherein a logic unit combines the outputs of the separate look up tables to develop a signal indicative of a display value for each pixel.

These and other features are obtained according to the invention by providing first and second look up tables addressed by first and second sets of displayable planes, respectively, and a logic unit for combining the data outputs of the look up tables, for each pixel, to develop a signal representative of the display value for that pixel. The logic unit provides different logical combinations of the first and second look up table data outputs corresponding to different desired display presentations. In one embodiment, the value of the data output of one look up table determines the logical combination or operation performed by the logic unit. In another, or further embodiment, a function controller provides a signal which determines the selected functions. The function controller may include a register loaded by a control program, or by a user-actuated selector or key which permits the operator to select the desired logical combination.

BRIEF DESCRIPTION OF THE DRAWINGS

These and other features of the invention and its relation to the prior art will be understood with reference to the figures, in which.

DETAILED DESCRIPTION

A Prior art display system for graphics display employs a display memory having addresses (x,y) corresponding to pixels $(x,y)_s$ on the display screen, and stores at each address (x,y) a word v(x,y) which represents an intensity value for controlling the display. The value v(x,y) at an address (x,y) in the display memory is fed to a digital to analog converter (DAC) which converts v to an analog output value for controlling the cathode ray tube or display. A common method of associating a digital value stored in a display memory with a video display signal is to let the most significant bit represent the desired display intensity. Other methods are possible. For instance, where the stored value v has more than 3N bits, the first N bits may represent one color value, the next N bits represent another color value, and the next N bits represent a third color value. Such a prior art system operates by feeding a video data stream to the display memory and obtaining a corresponding stream of stored display values v. These values are passed to the DAC which determines the analog control signals for the scanning beam which writes the display.

Figure 1:
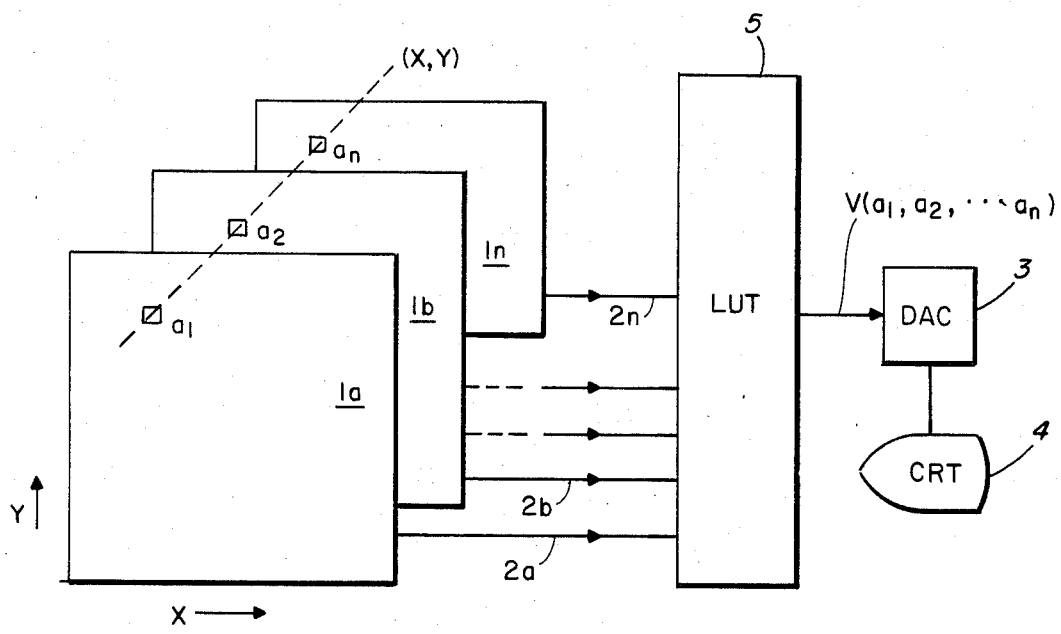
FIG. 1 (PRIOR ART)
FIG. 1 shows a prior art look up table arrangement for a multi-plane graphics system.

FIG. 1 shows a typical prior art system as used in a graphic display system. In a graphic display system having a plurality of display planes, a plurality of display memories 1*a*, 1*b*, . . . each represent a plane of graphic data. During the scanning of the display, the display memories, referred to as "planes" 1*a*, 1*b*, etc. are accessed in real time and the data $a_i$ stored at the address $(x,y)_i$ in each plane corresponding to a given pixel (x,y) are fed along corresponding address lines 2*a*, 2*b* . . . to a look up table 5. Look up table 5 determines the beam intensity displayed at each pixel, as a function of an input address formed from the data $\{a_i\}$ of all the planes at the location (x,y). Although on the display 4 only a small number of intensity values may be required, look up table 5 nonetheless must be quite large. This is because the intensity value will be a function of the display presentation, or view, of the multiple planes 1*a*, 1*b* . . . 1*n*. Where the LUT is addressed by n planes, the number of LUT storage locations is $2^n$.

In order to effect real time control of the graphics displayed on the screen, it is desirable that the accessing of the look up table take no more than 5 to 10 nanoseconds. However, the prior art look up tables for the display of multiple planes have required high density memory components with access times in the range of 25 nanoseconds or longer. The use of such memory components imposes design constraints on a graphic system, and in practice limits the number of displayable planes.

Figure 2:
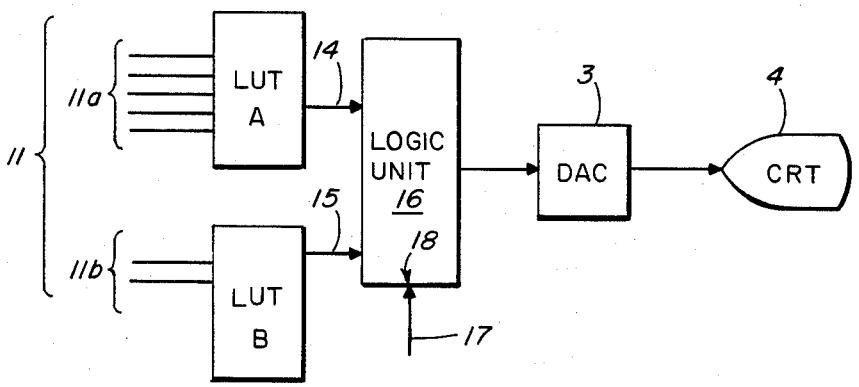
FIG. 2 is a block diagram of an embodiment of the present invention.

FIG. 2 shows a block diagram of a system according to the present invention, in which multiple look up tables are addressed by different sets of planes and the look-up table outputs are combined to form a display signal.

As shown in FIG. 2, a plurality of address lines 11, one from each display plane, address two or more look up tables 12, 13, referred to as LUT A and LUT B. The output lines 11*a* from a first set of display planes connect to the addressing inputs of LUT A, and the output lines 11*b* from a further set of display planes connect to the addressing inputs of LUT B. The outputs of LUTs 12, 13 are delivered along data lines 14, 15 respectively to a logical combining unit 16, which combines the signals on lines 14, 15 in a selected manner to provide a data output on line 18. This data output is converted by DAC 3 to an analog signal for controlling the display beam of CRT 4, in a conventional manner.

Logical combining unit 16 includes circuitry for logically combining the two signal on lines 14, 15, according to a selected logical function. The selection of the logical function is controlled by a function selection signal applied via line 17 to selection input 18 of the combining unit 16. Preferably combining unit 16 selectively combines its inputs according to any of a number of elementary logical functions, such as AND, OR, EXCLUSIVE OR, BLANK, SUM, PRIORITY, etc. The selection signal on line 17 may be a signal stored in a special function control register, the contents of which may be user-entered or may be set by a program. Alternatively, or in addition, a signal from a LUT output data line 14 or 15 may be provided directly to selection input 18 as a function selection signal. This is indicated by line 15*a*, shown in phantom, between LUT output 15 and selection input 18.

As shown in FIG. 2, lines 11 from the display planes include lines 11*a* from a first plurality of display planes, and one or more lines 11*b* from a further set of display planes. Thus LUT A and LUT B have totally separate address and data paths, with their output data combined in the combining unit 16 to develop the signal for controlling the display.

Thus, when LUT A is addressed by m planes, and LUT B is addressed by n planes, the total number of LUT storage locations will be $2^m+2^n$, rather than the $2^m2^n$ required by the prior art. Furthermore, the number of bits stored at each location may be different for LUT A and LUT B, allowing the use of smaller memory components. For example, some planes may require only an "on" or "off" display value, indicated by a single stored bit. Despite the smaller LUT memory requirements, a full range of display presentations is achieved by the present invention by combining the outputs of LUT A and LUT B according to different logical combinations.

The functions provided by the logical combining unit 16 preferably include functions for implementing the display presentations commonly programmed into a single larger look up table. The following functions are useful:

OVERLAY A ON B (or B ON A)
SUM A AND B
OR A AND B
SUPPRESS B WHERE A (or A WHERE B)
XOR B WITH A (or A WITH B)
SUPPRESS A (or B)
AND A AND B
MULT A*B

In addition, the combining unit may be periodically switched between two such functions, by a signal applied periodically to its selection input 18, in order to highlight a portion of a set of displayed planes.

In the prior art, the method of changing a display presentation requires changing the values stored in the look up table. Thus, if it were desired, for example, to change the display presentation to suppress the graphics planes where text is displayed, the look up table would be extensively rewritten so as to eliminate the display vale due to graphic material at those addresses where some text material appears. This involves rewriting whole blocks of the LUT, which, as noted above, is a high-density, slow access component.

According to one preferred embodiment of the present invention, such result is achieved by addressing one of the look up tables, e.g. LUT 13 of FIG. 2, only by the text planes. The output signal 15 of the small table is delivered to the combining unit 16 as a data signal at one input, and is also connected as a function selection signal at input 18 of the combining unit to select the "SUPPRESS A WHERE B" function. One bit, e.g. the least significant bit, of the LUT data output 15 may be used to select this SUPPRESS function. Combining unit 16 then passes the signal on line 15 to DAC 3, and suppresses the graphics signals on input line 14. When it is desired to change the display presentation to no longer suppress graphics at text locations, it is only necessary to rewrite a portion of the contents of LUT B rather than to rewrite or refresh the contents of all of the display look up tables.

Figure 3:
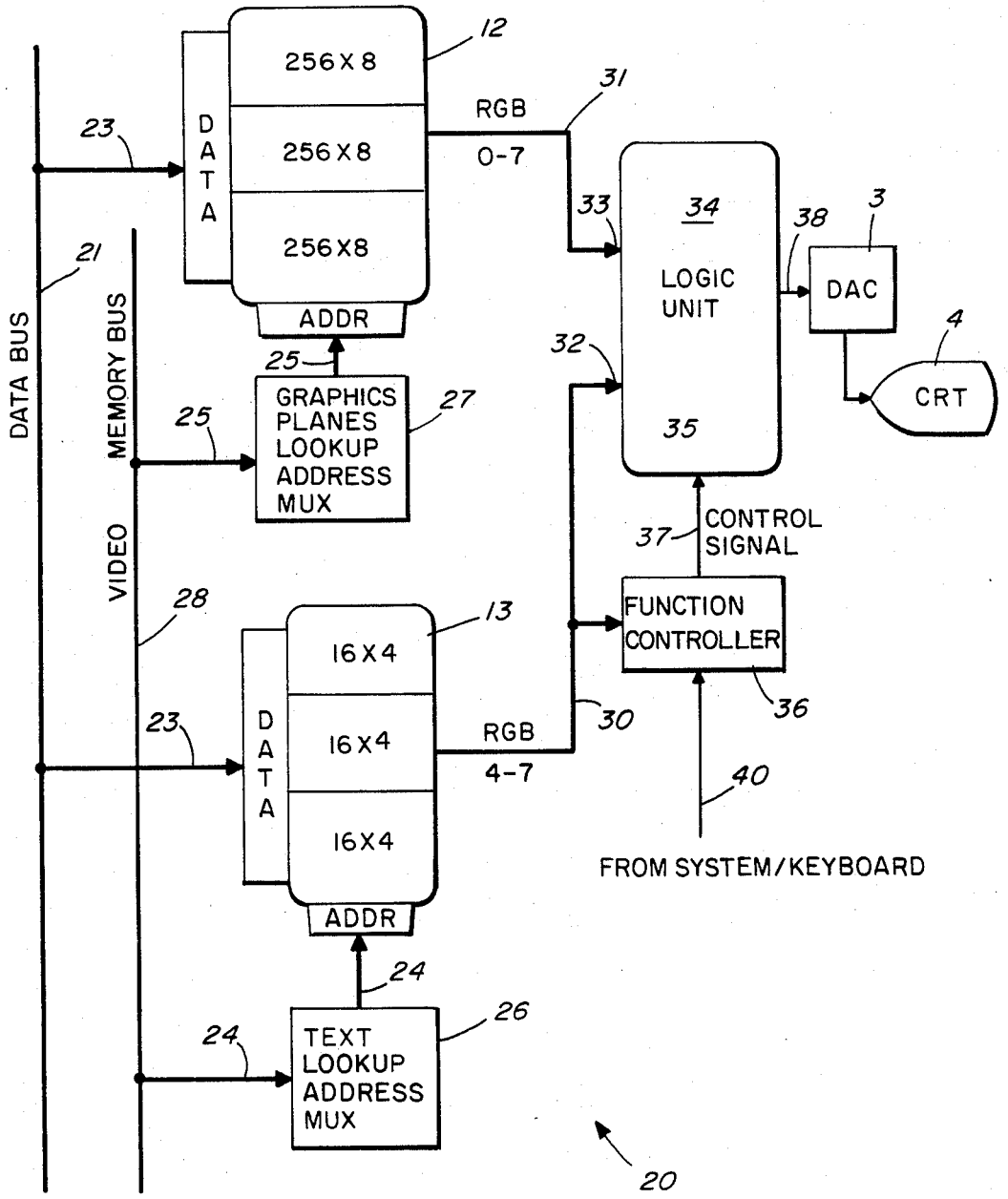
FIG. 3 shows a block diagram of an exemplary embodiment of the invention.

FIG. 3 shows a block diagram of an exemplary embodiment 20 of the invention having two look up tables and configured for displaying 4–16 graphics planes and 4 text planes. A data bus 21 writes the entries to look up tables 12, 13 along lines 23 under control of a program. Look up table 13 is a text look up table and comprises three 16×4 bit memories which are addressed by the outputs of the text planes provided from video memory bus 28 along address line 24 via text look up address MUX 26. Look up table 12 is a graphics look up table, and is addressed by the outputs of eight graphics planes provided from video memory bus 28 along address line 25 via graphics look up address MUX 27. Preferably, MUX 27 is configured to interface a selected eight of up to sixteen or more graphics planes from bus 28 with the graphics LUT. Graphics LUT 12 preferably is implemented as six 256×4 bit memories. The use of small memory components for LUT's 12, 13 results in access times in the range of 7 ns, thus permitting the real time accessing of raster scan control signals.

The data output of text LUT 13 is provided along line 30 to an input terminal 32 of a functional combining unit or logic unit 34. Similarly, the data output of graphics LUT 12 is provided along line 31 to a second input terminal 33 of unit 34. According to the broad principle of the invention, lines 30, 31 may be hard-wired together to provide the logical OR combination of the signals on lines 30, 31. More generally, unit 34 is a logic unit which, responsive to a control signal applied at control input terminal 35, operates on its inputs with a logical function determined by the control signal.

One preferred implementation of the invention, shown in FIG. 3, has text LUT data output line 30 connected to a controller 36, which may, for example, comprise a register for receiving and holding the signal on line 30, or one or more selected bits thereof, and for providing such bits as a control signal along line 37 to the control terminal 35 of the logic unit. For example, the least significant bit of data on text output line 30 may be applied as a control signal to the logic unit to determine a SUPPRESS function for eliminating the graphics display where text appears. Controller 36 may receive additional inputs along line 40, from a keyboard, from operation of a program, or from the graphics LUT output, for determining other control signals.

In a preferred embodiment, logic unit 34 develops an 8-bit word as its output signal, which is delivered along output line 38 to DAC 3. In this embodiment, the signals supplied along text LUT data line 30 are 4-bit signals corresponding to bits 4–7 of the nominal display control value, and the signals on graphics LUT data line 33 are 8-bit signals corresponding to a full 8-bit display control value. Function controller 36 is responsive to the presence of a selected high bit of the signal on line 30 to load an output register with a control signal for causing logic unit 34 to suppress the graphics input of line 31 and pass the signal on line 30 to the DAC.

It will be understood that in general a 4-bit or 8-bit word as described above may be provided to control the display of each of three primary colors. Accordingly in the discussion above, reference to lines carrying display control signals will be understood to refer to lines having one or more conductors or channels for carrying, respectively red, green and blue control signals.

It will be further understood that the above description has been by way of illustration, with regard to a preferred example, and that the invention is not limited to the examples described. The invention having been thus disclosed, modifications and variations will occur to those skilled in the art, and all such modifications and variations are intended to be within the scope of the following claims and the invention as defined thereby.

What is claimed is:

1. A display signal generating system comprising:

a. display memory having a plurality of data storage locations, and a plurality of address output signal lines, said display memory outputting on said address output signal lines an address or addresses corresponding to memory locations containing display data, b. first and second addressable look-up memories having a plurality of input address signal lines coupled to said address output signal lines from said display memory, each of said addressable memories having a plurality of data storage locations, and a plurality of data output signal lines, said memories each including means for generating a data signal on its data output signal lines representative of the data stored at the one of its locations corresponding to the location defining address signal applied to its input address signal lines from said address output signal lines of said display memory, and c. a logic unit having inputs coupled to said data output signal lines and a plurality of logic unit output signal lines, said logic unit combining the data output signals from said first and second address memories by a selected one of a set of predetermined combination operations to supply a graphics display signal on said logic unit output signal lines; and d. means, coupled to said logic unit, for applying a selection signal to said logic unit which determines the selected combination operation.

2. A display signal generating system as set forth in claim 1 wherein said means for applying a selection signal comprises a function controller having a first input and an output, said first input being coupled to a portion of the data output signal line for receiving a first instruction signal and said output supplying to said logic unit a selection signal determined by said instruction signal.

3. A system according to claim 1 wherein said set of predetermined operations includes at least two of the group of operations consisting of algebraic summation, algebraic multiplication, logical OR, logical exclusive OR, logical AND, IF A SUPPRESS B, and SUPPRESS A.

4. A display signal generating system as set forth in claim 2 wherein said function controller has a second input for accepting a second instruction signal from an external source, said selection signal at the output of said function controller being determined by the combination of said first and second inputs.

5. A system according to claim 1 further including a display controller wherein said controller is responsive to at least one of said data signals, to generate a control signal, and wherein said one operation is determined by said logic unit in response to said control signal.

6. A system according to claim 1 further comprising a digital-to-analog converter and associated raster display device, wherein said converter includes means responsive to said logic unit output signal to generate an intensity signal and means for applying said intensity signal to control the display intensity of said raster display device.

7. A display signal generating system for a raster scan display, such system comprising:

a. first and second addressable memories, each of said addressable memories having a plurality of data storage locations, a plurality of input address signal lines and a plurality of data output signal lines, said memories each including means for generating a digital data word on its data output signal lines representative of the data stored at the one of its locations corresponding to a location defining address signal applied to its input address signal lines, and b. logical combining means, in communication with the data output signal lines of said first and second addressable memories, for combining the digital data words according to a selected one of a set of logical function characteristics, said selected logical function characteristic determined by an external control system applied to the logical combining means, whereby to form a digital data word representative of a display value of a raster scan display, c. a digital-to-analog converter having a plurality of input data signal lines coupled to the output of said logical combining means and an output signal line, said digital-to-analog converter outputting an analog signal representative of the display value of the raster scan display corresponding to the digital data word output of the logical combining means.

8. A system according to claim 7 wherein said set of predetermined operations includes at least two of the group of operations consisting of algebraic summation, algebraic multiplication, logical OR, logical exclusive OR, logical AND, IF A SUPPRESS B, and SUPPRESS A.

9. A system according to claim 7 further including a display controller wherein said controller is responsive to at least one of said data signals, to generate a control signal, and wherein said one operation is determined by said combining means in response to said control signal.

10. A system according to claim 7 further comprising a digital-to-analog converter and associated raster display device, wherein said converter includes means responsive to said combining means output data signal to generate an intensity signal and means for applying said intensity signal to control the display intensity of said raster display device.

11. A display signal generating system for a raster scan display of the type having a look up table for storing data representative of raster scan intensity control values, and wherein the look up table is addressed by a plurality of displayable planes so as to deliver an intensity control signal for controlling the raster scan to display said planes, such system comprising:

first and second look up tables addressed by a first and a second set of displayable planes, respectively, so as to deliver along respective first and second output lines respective first and second stored intensity value signals; and a logic unit, in communication with said first and second output lines, for combining said first and second intensity value signals according to a selected logical function into a combined signal, said combined signal being an intensity control signal for controlling the raster scan.

12. A system according to claim 11 wherein said logical function is a selected one of a set of predetermined operations.

13. A system according to claim 12 wherein said set of predetermined operations includes at least two of the group of operations consisting of algebraic addition, algebraic multiplication, logical OR, logical exclusive OR, logical AND, IF A SUPRPESS B, and SUPPRESS B.

14. A system according to claim 11 wherein said logic unit is a hardwired junction of the first and second output lines and wherein the logical function is the logic OR.

15. A system according to claim 12 further including a display controller wherein said controller is responsive to at least one of said intensity control signals to generate a function control signal, and wherein said one operation is determined by said logic unit in response to said function control signal.

16. A system according to claim 11 further comprising a digital-to-analog converter and associated raster display device, wherein said converter includes means responsive to said logic unit combined signal to generate an intensity signal and means for applying said intensity signal to control the display intensity of said raster display device.

17. A system according to claim 11, wherein said first set of displayable planes comprises text planes, and wherein the logic unit is responsive to the first intensity value signal to combine said first and second signals by suppressing the second intensity value signal.

18. A system according to claim 11 wherein said logic unit further comprises a plurality of output line, said output lines being coupled to the input lines of a digital-to-analog converter, said digital-to-analog converter outputting an analog intensity control signal for controlling the raster scan corresponding to the digital intensity control signal received from said logic unit.

* * * * *